US005360704A

United States Patent [19]

Brennecke

[11] Patent Number: 5,360,704

[45] Date of Patent: Nov. 1, 1994

[54] COLOR PHOTOGRAPHIC RECORDING MATERIAL

[75] Inventor: Detlef Brennecke, Leichlingen, Germany

[73] Assignee: Agfa-Gevaert Aktiengesellschaft, Leverkusen, Germany

[21] Appl. No.: 88,255

[22] Filed: Jul. 7, 1993

[30] Foreign Application Priority Data

Jul. 21, 1992 [DE] Germany ..... 4224026

[51] Int. Cl.[5] ..... G03C 1/46

[52] U.S. Cl. ..... 430/506; 430/503; 430/963; 430/567

[58] Field of Search ..... 430/506, 503, 567, 963

[56] References Cited

U.S. PATENT DOCUMENTS 5,057,405 10/1991 Shiba et al. ..... 430/506

5,093,227 3/1992 Nakazyo et al. ..... 430/963

OTHER PUBLICATIONS

*Technical Photographic Handbook* (New Edition), pp. 522–523, Corona Publishing Co., Ltd., 1987.

*Primary Examiner*—Charles L. Bowers, Jr.
*Assistant Examiner*—Geraldine Letscher
*Attorney, Agent, or Firm*—Connolly & Hutz

[57] ABSTRACT

A camera-sensitive color photographic recording material which comprises 2 or 3 green-sensitive layers, 2 or 3 red-sensitive layers and 2 or 3 blue-sensitive layers, the blue-sensitive layers being arranged further from the support than the green-sensitive and red-sensitive layers, the layer of low blue-sensitivity or the layer of low blue sensitivity and the layer of medium blue sensitivity being made up of silver halide emulsions containing at least 50 mol-% AgCl and the total silver coating of the material being adjusted as a function of sensitivity to a value which satisfies the following relation:

$$Ag\ \text{coating} = (0.27 \cdot S) - X,$$

the silver coating being determined in g/m$^2$, X having a value of 1.9 to 3.8 and S being the sensitivity in DIN, is distinguished by improved sharpness.

13 Claims, No Drawings

COLOR PHOTOGRAPHIC RECORDING MATERIAL

This invention relates to a camera-sensitive color photographic recording material which comprises at least two blue-sensitive silver halide emulsion layers differing in their sensitivity such that at least one layer has less sensitivity than another more sensitive layer, at least two green-sensitive layers differing in their sensitivity such that at least one layer has less sensitivity than another more sensitive layer and at least two red-sensitive layers differing in their sensitivity such that at least one layer has less sensitivity than a more sensitive layer and which is distinguished by improved sharpness.

Camera-sensitive color photographic silver halide recording materials, more particularly color negative films, are normally built up with double or triple layers for each of the spectral regions blue, green and red, silver bromide iodide emulsions normally being used as the silver halide emulsions to achieve adequate sensitivity. The color-sensitive layers are divided up into double or triple layers to obtain a good sensitivity-to-grain ratio.

It has also been proposed (Research Disclosure 32 569, May 1991) to use silver halide emulsions of high AgCl content for camera-sensitive recording materials. The silver halide emulsions in question can have adequate sensitivity when the knowledge of modern emulsion technology, film production using selected stabilizers, sensitizers, color couplers, DIR couplers, DAR couplers, development accelerators, bleaching accelerators and special processing is applied to these emulsions.

An improvement in sharpness was expected from the fact that a relatively thin material relatively poor in silver with relatively little light scattering power is obtained where high-chloride emulsions are used. If, in addition, the yellow filter layer is to be omitted, all the red-sensitive and green-sensitive layers would have to consist of high-chloride silver halide emulsions because silver halide emulsions with a high bromide content of the silver halide are inherently sensitive to blue light and have to be separated from the light source by a yellow filter layer which normally contains colloidal silver unless their blue sensitivity is to be utilized. In the only Example on page 338, at least one blue-sensitive layer is made up of at least 80 mol-% AgBr. In addition, the material contains a yellow filter layer, the more sensitive silver halide emulsion layers for the green and/or red spectral region having high bromide contents and being arranged below the yellow filter layer and below the low-sensitivity and/or medium-sensitivity green- and/or red-sensitized silver halide emulsion layers with their high AgCl contents.

A material of the type in question still shows inadequate sensitivity, the increase in sharpness being extremely small.

The problem addressed by the present invention was considerably to improve the sharpness of camera-sensitive silver halide recording materials without any loss of sensitivity.

According to the invention, this object is achieved by combination of the following measures:

1. 2 or 3 green-sensitive layers are provided;
2. 2 or 3 red-sensitive layers are provided;
3. 2 or 3 blue-sensitive layers are provided;

4. the blue-sensitive layers are arranged further from the support than the green-sensitive and red-sensitive layers;
5. the layer of low blue sensitivity or the layer of low blue sensitivity and the layer of medium blue sensitivity are made up of silver halide emulsions contain at least 50 mol-% AgCl and preferably at least 80 mol-% AgCl;

6. the total silver coating of the material is adjusted as a function of sensitivity to a value which satisfies the following relation:

$$Ag\ \text{coating} = (0.27 \cdot S) - X,$$

the silver coating being determined in g/m$^2$, X having a value of 1.9 to 3.8 and S being the sensitivity in DIN.

In a preferred embodiment, all the silver halide emulsion layers of low sensitivity and, in the case of three-layer materials, all the silver halide emulsion layers of low and medium sensitivity are made up of silver halide emulsions containing at least 50 mol-% AgCl and preferably at least 80 mol-% AgCl. In a particularly preferred embodiment, however, this applies to the blue- and green-sensitive layers.

The equivalent particle diameter of all the silver halide emulsions is between 0.1 and 3 μm and, more particularly, between 0.2 and 2 μm. In a particularly preferred embodiment, the low-sensitivity or the low- and medium-sensitivity blue-sensitive silver halide emulsions of high chloride content have an equivalent particle diameter of 0.3 to 1.5 μm.

The high-sensitivity layers for all the spectral regions may as usual be silver bromide iodide emulsions which are separated from the light source by a typical yellow filter layer where they are green- or red-sensitized. However, high-chloride silver halide emulsions differing essentially in their equivalent particle diameters may also be used in all the layers. The more sensitive silver halide emulsion layers are preferably arranged further from the support than the less sensitive silver halide emulsion layers of the same spectral sensitivity.

The remaining halide component of the high-chloride silver halide emulsions may be bromide and/or iodide.

The particle distribution of the emulsions may be monodisperse, i.e. the deviations from the mean particle diameter are no more than ±40%. The emulsions may also be heterodisperse and may have a broad particle size distribution. Mixtures of several monodisperse emulsions differing in their particle diameter may also be used for the production of the individual color layers, in which case the particle diameters or the edge length of the various emulsions may differ by up to 50 times and preferably by up to 20 times. Heterodisperse emulsions differing in their average particle diameter or heterodisperse and homodisperse emulsions may also be mixed, in which case the average particle diameter may again differ by a factor of 50.

The emulsions may be precipitated, freed from inorganic salts and purified by the methods described on pages 325 to 331 of Research Disclosure 32 569, May 1991.

The color photographic emulsions of high AgCl content may be spectrally sensitized using methine dyes or other dyes. Dyes from the group of cyanine dyes, merocyanine dyes and complex merocyanine dyes are particularly suitable.

A review of the polymethine dyes suitable as spectral sensitizers, suitable combinations thereof and supersensitizing combinations thereof can be found in Res. Discl., Vol. 176, 17 643 (1978), Res. Discl., Vol. 225, 22 534 (1983) and EP-A 0 261 244, EP-A 0 243 099, DE 35 39 930, EP-A 0 178 097, GB 2,176,304, DE 35 26 670 and U.S. Pat. No. 4,552,834.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dyes contain at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

There is no need to use spectral sensitizers where the sensitivity inherent in the silver halide is sufficient for a certain spectral region, for example when AgI or AgIBr has been used as the host crystal for the epitactic precipitation of AgCl.

The spectral sensitizers may be added to the silver halide emulsions of high AgCl content before, during or after physical ripening (Ostwald ripening) during precipitation of the silver halide. The spectral sensitizers may also be added to the silver halide emulsions before or during or after chemical ripening. The spectral sensitizers may also be added to the emulsions just before casting.

Luminescent substances, such as water-soluble cyanines and/or water-soluble merocyanines, xanthene dyes, acridine dyes, oxazine dyes, thiazine dyes, riboflavins, triacetal methane dyes, aminonaphthol dyes, pyrene dyes, coumarin dyes, porphyrin dyes, phthalocyanine dyes (EP-A-0 270 082), may also be added to the silver halide emulsions of high AgCl content.

Non-diffusing monomeric or polymeric color couplers are associated with the emulsion layers of different sensitivity and may be disposed in the same layer or in a layer adjacent the photosensitive silver halide layer.

These color couplers are capable of releasing development-inhibiting substances (DIR couplers), development-accelerating substances (DAR couplers) or couplers which accelerate bleaching of the developed silver (BAR couplers) during the coupling reaction.

The color couplers used should be highly reactive and should give a good color yield. In view of the need for print compatibility, the absorption properties should lie in the following ranges: $\lambda_{max}$ approx. 450 nm±2 nm for yellow couplers, approx. 551 nm±3 nm for magenta couplers and approx. 696 nm±3 nm for cyan couplers. The color couplers should show high stability in storage at high temperatures and/or high atmospheric humidity; stability to harmful gases, particularly formalin, should be good and the dye images obtained after coupling should also be stable to light and also to dark reactions. In addition, the color couplers used should show high processing stability, i.e. variations in temperature, in the concentration of the development substances and in the pH value should have no effect on the results obtained. Accordingly, 2-equivalent couplers which show relatively high reaction kinetics and which enable silver to be saved are preferably used. The use of high molecular weight couplers is also particularly preferred.

A list of color couplers which may be used can be found in the following patent specifications:

Yellow couplers: EP-A-0 327 348, EP-A-0 304 810, EP-A-0 205 583, U.S. Pat. Nos. 4,791,050, 4,770,983, DE 3 741 088, DE 3 803 664.

Magenta couplers: EP-A-0 232 101, EP-A-0 326 406, EP-A-0 320 776, EP-A-0 081 768, EP-A-0 309 158, EP-A-0 294 681, EP-A-0 294 785, DE 3 730 557, DE 3 732 512.

Cyan couplers: EP-A-0 166 417, EP-A-0 270 341, EP-A-0 397 935, EP-A-0 304 856, EP-A-0 330 443, EP-A-O 028 099, EP-A-0 084 100, DE 3 823 049.

Other descriptions of color couplers can be found in U.S. Pat. Nos. 4,804,620, 4,741,994, 4,663,272, 4,837,136, EP-A-0 013 083, EP-A-0 114 674, EP-A-0 095 722, EP-A-0 073 636 and Chem. Listy 82, (1988), 12, 1254–1281.

Cyan couplers are normally associated with the red-sensitive layers, magenta couplers are normally associated with the green-sensitive layers and yellow couplers are normally associated with the blue-sensitive layers.

Color couplers for producing the cyan dye image are generally couplers of the phenol or α-naphthol type of which the following are suitable examples:

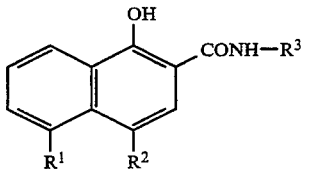

in which $R_1$ is hydrogen or a substituent, optionally a ballast group, $R_2$ is hydrogen or a leaving group and $R_3$ is generally a ballast group, so that the coupler contains at least one ballast group;

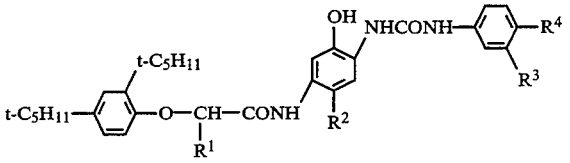

in which $R_1$ is a lower alkyl radical, $R_2$ is hydrogen or a leaving group and $R_3$ and $R_4$ are hydrogen or a substituent, for example cyano, halogen or alkyl sulfonyl;

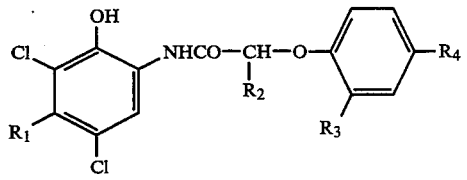

in which
$R_1$ is methyl or ethyl,
$R_2$ is hydrogen or alkyl and
$R_3$ and $R_4$ are tertiary alkyl groups;

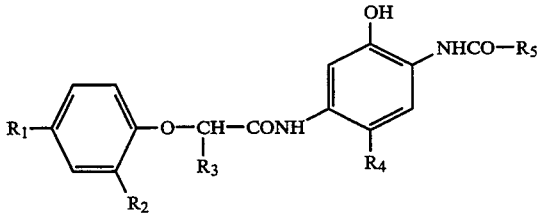

in which
$R_1$ and $R_2$ are tertiary alkyl groups,
$R_3$ is hydrogen or alkyl,
$R_4$ is hydrogen or a leaving group and
$R_5$ is alkyl or aryl.

Color couplers for producing the magenta dye image are generally couplers of 5-pyrazolone, indazolone or pyrazoloazole type, of which the following are suitable examples:

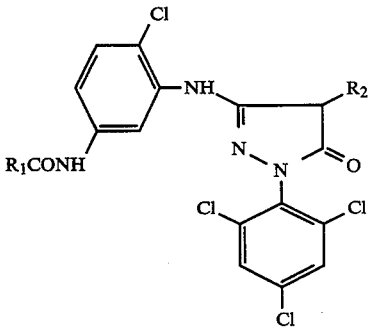

in which
$R_1$ is a ballast group and
$R_2$ is hydrogen or a leaving group;

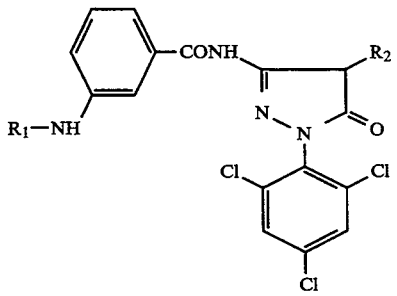

in which
$R_1$ is a ballast group and
$R_2$ is hydrogen or a leaving group;

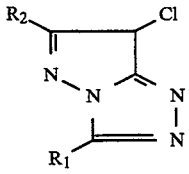

in which
$R_1$ is a ballast group and
$R_2$ is a lower alkyl group.

Color couplers for producing the yellow dye image are generally couplers containing an open-chain ketomethylene group, more particularly couplers of the α-acyl acetamide type, of which suitable examples are α-benzoyl acetanilide couplers and α-pivaloyl acetanilide couplers corresponding to the following formulae

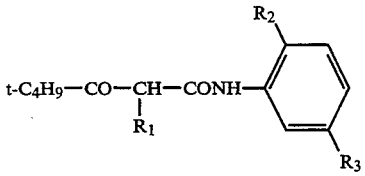

in which
$R_1$ is hydrogen or a leaving group, generally a further-substitued phenoxy or a nitrogen heterocycle attached by N,
$R_2$ is halogen or long-chain alkoxy and
$R_3$ is a substituent, more particularly a ballast group;

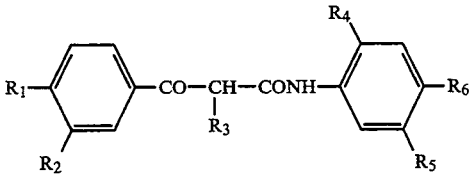

in which
$R_1$ is hydrogen or alkoxy,
$R_2$ is hydrogen or a ballast group,
$R_3$ is hydrogen or a leaving group,
$R_4$, $R_5$ and $R_6$ are hydrogen or a substituent, for example alkoxy, alkoxycarbonyl, halogen or dialkyl aminosulfonyl, so that the coupler contains at least one ballast group.

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

Examples of white couplers are pyrazolones substantially corresponding to the magenta couplers which contain a non-releasable substituent in the 4-position.

Examples of mask couplers are pyrazolone magenta couplers and naphthol cyan couplers which, in the coupling positions, contain an arylazo group or a releasable group containing an arylazo group.

DIR couplers which release development inhibitors of the azole type, for example triazoles and benzotriazoles, are described in DE-A-2 414 006, 2 610 546, 2 659 417, 2 754 281, 2 726 180, 3 626 219, 3 630 564, 3 636 824, 3 644 416 and 2 842 063. Further advantages in regard to color reproduction, i.e. color separation and color purity, and reproduction of detail, i.e. sharpness and grain, can be obtained with DIR couplers which, for example, do not release the development inhibitor directly in consequence of coupling with an oxidized color developer, but only after another reaction achieved, for example, with a timing group. Corresponding examples can be found in. DE-A-28 55 697, 32 99 671, 38 18 231, 35 18 797, in EP-A-157 146 and 204 175, in U.S. Pat. Nos. 4,146,396 and 4,438,393 and in GB-A-2,072,363.

DIR couplers releasing a development inhibitor which is decomposed to photographically substantially inactive products in the developer bath are described, for example, in DE-A-32 09 486 and in EP-A-167 168 and 219 713. Uninterrupted development and constant processing are achieved by this measure.

Where DIR couplers, particularly those releasing a readily diffusible development inhibitor, are used, improvements in color reproduction, for example more differentiated color reproduction, can be obtained by taking suitable measures during optical sensitization, as described for example in EP-A-115 304, 167 173, GB-A-2,165, 058, DE-A-3 700 419 and U.S. Pat. No. 4,707,436.

The DIR couplers may be added to a broad range of layers, including for example non-photosensitive layers or interlayers, in a multilayer photographic material. However, they are preferably added to the photosensitive silver halide emulsion layers, the characteristic properties of the silver halide emulsion, for example its iodide content, the structure of the silver halide crystals and their size distribution influencing the photographic properties obtained. The influence of the inhibitors released can be limited, for example, by the incorporation of an inhibitor trapping layer according to DE-A-24 31 223. For reasons of reactivity or stability, it can be of advantage to use a DIR coupler which, in the particular layer into which it is introduced, forms a color differing from the color to be produced in that layer during the coupling reaction.

Sensitivity, contrast and maximum density may be increased by using above all DAR or FAR couplers which release a development accelerator or a fogging agent. Compounds of this type are described, for example, in DE-A-2 534 466, 3 209 110, 3 333 355, 3 410 616, 3 429 545, 3 441 823, in EP-A-89 834, 110 511, 118 087, 147 765 and in U.S. Pat. Nos. 4,618,572 and 4,656,123.

An example of the use of DAR couplers can be found in EP-A-193 389.

It can be of advantage to modify the effect of a photographically active group released from a coupler by subjecting that group to an intermolecular reaction with another group after its release in accordance with DE-A-3 506 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-1 547 640).

The releasable group may also be a ballast group, so that coupling products which are diffusible or which at least show slight or limited mobility are obtained in the reaction with color developer oxidation products (U.S. Pat. No. 4,420,556).

The material may also contain compounds different from couplers which may release, for example, a development inhibitor, a development accelerator, a bleaching accelerator, a developer, a silver halide solvent, a fogging agent or an anti-fogging agent, for example so-called DIR hydroquinones and other compounds of the type described, for example, in U.S. Pat. Nos. 4,636,546, 4,345,024, 4,684,604 and in DE-A-3 145 640, 2 515 213, 2 447 079 and in EP-A-198 438. These compounds perform the same function as the DIR, DAR or FAR couplers except that they do not form coupling products.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

Couplers which release a bleaching accelerator (BAR couplers) may also be used.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Suitable agents of the type in question, which are also known as scavengers or DOP trappers, are described in Research Disclosure 17 643 (1978), Chapter VII, 17 842 (1979), pages 94–97 and 18 716 (1979), page 650 and in EP-A-69 070, 98 072, 124 877, 125 522 and in U.S. Pat. No. 463,226.

The following are examples of particularly suitable compounds:

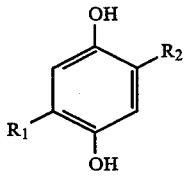

in which $R_1$ and $R_2$ are relatively long-chain alkyl radicals and the compound

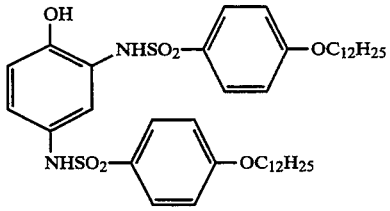

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, etc.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

The following are examples of particularly suitable compounds:

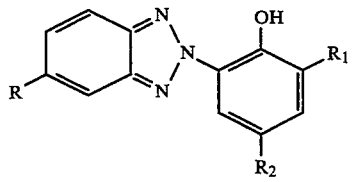

in which

R is hydrogen or chlorine, $R_1$ is hydrogen or alkyl and $R_2$ is alkyl; alkyl being in particular lower branched alkyl,

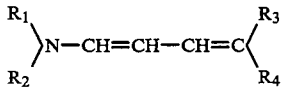

oder

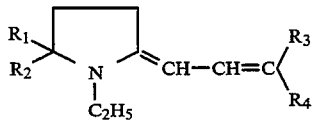

in which $R_1$, $R_2$ are alkyl or alkenyl and $R_3$, $R_4$ are cyano, phenylsulfonyl or alkylaminocarbonyl.

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, pages 22 et seq., in U.S. Pat. Nos. 2,632,701 and 3,269,840 and in GB-A-852,075 and 1,319, 763.

Certain binder layers, particularly the layer furthest from the support, but occasionally interlayers as well, particularly where they are the layer furthest from the support during production, may contain inorganic or organic, photographically inert particles, for example as matting agents or as spacers (DE-A-33 31 542, DE-A-34 24 893, Research Disclosure 17 643 (December 1978), Chapter XVI, pages 22 et seq.).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Suitable formalin scavengers are, for example, open-chain or cyclic urea derivatives.

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impairment (deterioration or degradation) as a result of the effect of light.

The emulsion layers or adjacent layers or the backing layers of the photographic support material may also contain antistatic substances (Res. Discl., Vol. 176 (1978), No. 17 643, Chapter XIII; EP-A 0 243 099).

The emulsions of high AgCl content may also contain compounds which accelerate development. These compounds may be precursors of development substances (U.S. Pat. Nos. 3,342,597, 3,342,599; Res. Discl., Vol. 148, No. 14 850 and Vol. 151, No. 15 159). However, developer compounds, such as 1-phenyl-3-pyrazolidone, and other compounds may be added to the emulsion layers or to adjacent layers (JP-N 64339/81, 144547/82, 211147/82, 50532/83, 0536/83, 50533/83, 50534/83, 50535/83, 115438/83).

The layers of the photographic recording material may be hardened with the usual hardeners. It is important in this regard to distinguish between hardeners which crosslink the gelatin solely through the amino groups and hardeners which activate the carboxyl groups of the gelatine so that crosslinking through the formation of isopeptide groups takes place in a second reaction with the amino group of the gelatine. A third group of hardeners crosslinks the gelatine through the carboxyl group of the gelatine.

Hardeners which crosslink the gelatine through the amino groups are, for example, formaldehyde, glutaraldehyde and similar aldehyde compounds; diacetyl, cyclopentadione and similar ketone compounds: bis-(2-chloroethyl urea), 2-hydroxy-4,6-dichloro-1,3,5-triazine and other compounds containing reactive halogen (U.S. Pat. Nos. 3,288,775, 2,732,303, GB 974,723 and GB 1,167,207). Divinyl sulfone compounds, 5-acetyl-1,3-diacryloyl hexahydro-1,3,5-triazine and other compounds containing reactive olefin compounds (U.S. Pat. Nos. 3,..65 718, 3,232,763 and GB 994,869) are also suitable. Derivatives of vinyl sulfones which are converted into the vinyl sulfone compounds by alkali treatment or storage may also be used. Also suitable are the vinyl sulfones of heteroaromatic compounds, tri- and tetravinyl sulfones and derivatives thereof. N-hydroxymethyl phthalimide and other N-methylol compounds (U.S. Pat. Nos. 2,732,316 and 2,586,168), isocyanates (U.S. Pat. No. 3,103,437), aziridine compounds (U.S. Pat. Nos. 3,017,280 and 2,983,611), acid derivatives (U.S. Pat. Nos. 2,725,294 and 2,725,295) and also halocarboxyaldehydes, such as mucochloric acid; dioxane derivatives, such as dihydrodioxane and dichlorodioxane, may also be used. Epoxy compounds (U.S. Pat. No. 3,901,537) and compounds of the isoxazole type (U.S. Pat. Nos. 3,321,313 and 3,543,292).

In order individually to harden certain layers of a multilayer material, polymeric non-diffusing hardeners may be added to the gelatine emulsion. These polymeric compounds may contain any functional groups reacting with the amino groups or the carboxyl groups of the gelatine. The polymer backbone must contain water-solubilizing groups, such as —$SO_3Na$, —COO—Na or other groups (DE 34 33 893). Hardeners which activate the carboxyl group of the gelatine and which lead to crosslinking through isopeptide groups are those of the carbodiimide type (U.S. Pat. No. 3,100,704) or of the carbamoyl pyridinium type (DE 24 08 814), compounds containing a phosphorus/halogen compound (JP-A 113929/83, N-carbonyl oximide compounds (JP-A 43 353/81), N-sulfoximido compounds (U.S. Pat. No. 4,111,926), dihydroquinoline compounds (U.S. Pat. No. 4,013,468), 2-sulfonyloxy pyridinium salts (JP-A 110 762/81), formamidinium salts (EP-A-0 162 308) and compounds containing two or more N-acyloximino groups (U.S. Pat. No. 4,052,373).

Compounds which crosslink the gelatine through the carboxyl groups are preferably inorganic salts, such as chromium salts, zirconium salts and aluminium salts.

The development of the color photographic materials containing the emulsions of high AgCl content in the individual photosensitive layers takes place in an alkaline aqueous solution containing an aromatic primary amine as developer substance. Suitable aromatic primary amines are compounds of the p-phenylenediamine series., such as 3-methyl-4-amino-N-ethyl-N-hydroxyethyl aniline, 3-methyl-4-amino-N,N'-diethyl aniline, 3-methyl-4-amino-N-ethyl-N'-$\beta$-methanesulfonamidoethyl aniline and acidic salts thereof.

Aminophenol derivatives, such as o-aminophenol, p-aminophenol, 4-amino-2-methyl phenol, 2-amino-3-methyl phenol, 2-oxy-3-aminophenol, 4-dimethylaminobenzene etc. derivatives, and 1-phenyl-3-pyrazolidone may also be used.

Two or more developer substances may also be used simultaneously in the developer solutions. The processing temperatures may vary from 18° C. to 50° C., a preferred temperature range being from 30° C. to 40° C.

The pH value of the developer may be between 9.5 and 13.5. A pH value of 10.0 to 10.5 is particularly preferred. The developer contains chloride ions in a concentration of $1.4 \cdot 10^{-2}$ mol/l to $2.8 \cdot 10^{-1}$ mol/l and preferably in a concentration of $2.8 \cdot 10^{-2}$ mol/l to $7 \cdot 10^{-2}$ mol/l. In addition, the developer may contain bromide ions in a quantity of $0.5 \cdot 10^{-4}$ mol/l to $1.25 \cdot 10^{-3}$ mol/l and preferably in a quantity of $1.25 \cdot 10^{-4}$ mol/l to $3.72 \cdot 10^{-4}$ mol/l.

To adjust the pH value, the color developer contains buffers, such as carbonates, borates, phosphates of alkali metals.

The developer may also contain stabilizers, such as hydroxylamines, triethanolamine and alkali metal or ammonium salts, sulfites and bisulfites. Diethyl hydroxylamine is particularly preferred as the stabilizer.

The developer may also contain organic solvents, such as benzyl alcohols, diethylene glycol, etc.

The developer may contain complexing agents, such as ethylenediamine tetraacetic acid, diethylenetriamine pentaacetic acid, nitrilotriacetic acid, cyclohexane diaminotetraacetic acid, iminodiacetic acid, N-hydroxymethyl ethylenediamine triacetic acid, the alkali metal salts of the compounds mentioned being used. Other compounds which may be used as complexing agents are organophosphorus compounds (Res. Discl., Vol. 181, No. 18 170 (1979)).

The developer solution may also contain development accelerators, such as benzyl alcohol or compounds of the pyridinium series (U.S. Pat. Nos. 2,648,604, 3,171,247). In addition, the developer solutions may contain cationic dyes, such as phenofuranin, and also polythioethers (U.S. Pat. Nos. 2,533,990, 2,531,832, 2,950,970, 2,577,127 and 3,201,242).

Developers particularly suitable for the emulsions of high AgCl content can be found in WO 8 704 534, EP-A 080 805, EP-A-231 861, EP-A-234 292, EP-A-243 096, EP-A-255 402, EP-A-293 917, EP-A-312 984, DE 3 243 907, U.S. Pat. Nos. 4,183,756, 4,766,057, 4,774,167.

The developers may also contain antifogging agents, such as N-containing heterocyclic compounds, for example benzotriazoles, 6-nitrobenzimidazoles, 5-nitroisoindazoles, 5-methyl benzotriazoles, 5-nitrobenzotriazoles, 5-chlorobenzotriazoles, 2-thiazolyl benzimidazoles, 2-thiazolyl methyl benzimidazoles, hydroxyazaindolizines, etc., heterocyclic compounds, such as 1-phenyl-5-mercaptotetrazole, 2-mercaptobenzimidazole, 2-mercaptobenzothiazole. Mercapto-substituted aromatic compounds, such as thiosalicylic acid, may also be used. Combinations of stabilizers such as these (antifogging agents) with developer substances can be found in EP-A-080 896, EP-A-246 624 and EP-A-255 784.

Combinations of the described developer solutions with special layer constituents, for example special color couplers, sensitizing dyes, hardeners, etc. are described in DE 3 301 105, EP-A-082 649, EP-A-231 832, EP-A-232 770, EP-A-243 100 and US 4,766,57 . . .

The photographic layers containing the emulsions of high AgCl content may also be treated solely with an activator solution in cases where a masked developer has been incorporated in the layer packets. Corresponding processes are described in DE 3 202 002, DE 3 127 279, DE 3 129 279 and EP-A-080 896.

The color photographic material containing the emulsions of high AgCl content is subjected to bleaching and fixing after development. The two processes may be carried out separately or at the same time as a so-called bleaching/fixing process.

Suitable bleaching agents are compounds of polyvalent metals, for example Fe(III), Co(III), Cr(IV), Cu(II), etc. and organic compounds, for example peracids, quinones, nitroso compounds, etc. The following are mentioned as examples: ferricyanides, bichromates and/or organic complex salts of Fe(III) or Co(III). Complex salts of the polyvalent metals with aminopolycarboxylic acids, such as ethylenediamine tetraacetic acid, diethylenetriamine pentaacetic acid, nitrilotriacetic acid, 1,3-diamino-2-propanol tetraacetic acid, citric acid, tartaric acid, are also suitable bleaching agents.

The bleaching agents are generally present in the form of alkali metal or ammonium salts.

Suitable fixing agents are the alkali metal or ammonium salts of thiosulfate, thiocyanate and also thioether and thiourea.

If the process is carried out as a bleaching/fixing process, the solution contains both a bleaching agent and a fixing agent.

The bleaching bath may also contain bleaching accelerators. Examples of such compounds are thiourea derivatives, heterocyclic compounds, thioethers, quaternary amines and thiocarbamoyl compounds. These compounds are described, for example, in U.S. Pat. Nos. 4,506,007, 4,578,345, 5,605,611, DE 3 635 391, EP-A-147 087, EP-A-173 540.

Bleaching and fixing of the color photographic materials are also described in Res. Discl., Vol. 201, No. 20 111 (1981) and Res. Discl., Vol. 207, No. 20 744 (1981).

After bleaching and fixing, the material is rinsed with water or treated with a stabilizing solution.

If the color photographic material is rinsed with water, it is then passed through a finishing bath containing 10% by weight formalin in quantities of 1 ml/l to 10 ml/l and a wetting agent in a quantity of 0.1 to 1 ml/l.

If, by contrast, a stabilizing bath is used, in which case the film generally passes through several baths on the countercurrent principle, such compounds as inorganic phosphoric acids, aminopolycarboxylic acids and phosphonocarboxylic acids may be added to the stabilizing solution. In addition, the stabilizing baths may contain borates, phosphates, carbonates, etc. as buffers for establishing a certain pH value.

The stabilizing bath may also contain formalin and growth inhibitors for fungi and bacteria, for example isothiazolones, 4-thiazolyl benzimidazoles, halogenated phenol benzotriazoles, benzoic acid, sulfonamides, etc. In addition, wetting agents, whiteners and hardeners may be added to the stabilizing solution. Baths such as these, which are suitable for processing the silver halide emulsions of high AgCl content, are described in EP-A 071 402, EP-A 165 805, DE 3 412 684, DE 3 412 857 and DE 3 436 862.

EXAMPLE

The compositions of various color negative materials, two comparison materials and two materials corresponding to the invention are shown in Table 2. The materials are adjusted to a photographic sensitivity of 24 DIN (200 ASA) and differ solely—as indicated in Table 2—in the use of different emulsions which are characterized in Table 1:

Blue, Green, Red layer signifies a layer of comparatively high sensitivity while blue, green, red layer signifies a layer of comparatively low sensitivity.

TABLE 1

| Emulsion [No.] | Halide composition [Cl/Br/I] | Average particle size [μm] | Particle size distribution (rel. standard dev.) [%] | Particle shape |
|---|---|---|---|---|
| 1 | 0/91/9 | 1.4 | 36 | Twinned |
| 2 | 10/84/6 | 0.3 | 19 | Spherical |
| 3 | 0/90/10 | 1.0 | 31 | Twinned |
| 4 | 10/84/6 | 0.3 | 19 | Spherical |
| 5 | 0/91/9 | 1.4 | 36 | Twinned |
| 6 | 10/87/3 | 0.5 | 9 | Spherical |
| 7 | 69/25/6 | 0.6 | 23 | Cubic |
| 8 | 85/10/5 | 0.7 | 18 | Cubic |

TABLE 1-continued

| Emulsion [No.] | Halide composition [Cl/Br/I] | Average particle size [μm] | Particle size distribution (rel. standard dev.) [%] | Particle shape |
|---|---|---|---|---|
| 9 | 70/27/3 | 0.7 | 21 | Cubic |

TABLE 2

| Material 1 (comparison) Ag coating = 5.8 g/m² | Material 2 (comparison) Ag coating = 5.9 g/m² | Material 3 (invention) Ag coating = 4.4 g/m² | Material 4 (invention) Ag coating = 4.3 g/m² |
|---|---|---|---|
| Protection layer | Protection layer | Protection layer | Protection layer |
| Blue layer | Blue layer | Blue layer | Blue layer |
| blue layer | blue layer | blue layer | blue layer |
| Yellow filter layer | Interlayer | Yellow filter layer | Yellow filter layer |
| Green layer | green layer | Green layer | Green layer |
| green layer | red layer | green layer | green layer |
| Interlayer | Yellow filter layer | Interlayer | Interlayer |
| Red layer | Green layer | Red layer | Red layer |
| red layer | Interlayer | red layer | red layer |
| Anithalo layer | Red layer | Anithalo layer | Anithalo layer |
| | Anithalo layer | | |

Table 3 shows which emulsions are used in which layers of which materials.

Table 4 shows the sharpness-characterizing measured values of the modulation transfer function of the described materials on exposure with blue, green and red light at various local frequencies in lines/mm. The claimed materials show improved sharpness properties in relation to the comparison materials.

TABLE 3

| Emulsion layer | Material 1 (comparison) | Material 2 (comparison) | Material 3 (invention) | Material (invention) |
|---|---|---|---|---|
| Blue layer | Emulsion 1 | Emulsion 1 | Emulsion 1 | Emulsion 1 |
| blue layer | Emulsion 2 | Emulsion 2 | Emulsion 7 | Emulsion 7 |
| Green layer | Emulsion 3 | Emulsion 3 | Emulsion 3 | Emulsion 3 |
| green layer | Emulsion 4 | Emulsion 8 | Emulsion 4 | Emulsion 8 |
| Red layer | Emulsion 5 | Emulsion 5 | Emulsion 5 | Emulsion 5 |
| red layer | Emulsion 6 | Emulsion 9 | Emulsion 6 | Emulsion 9 |

TABLE 4

| Exposure | Local frequency in lines/mm | Material 1 (comparison) | Material 2 (comparison) | Material 3 (invention) | Material (invention) |
|---|---|---|---|---|---|
| blue | 10 | 0.938 | 0.940 | 0.944 | 0.944 |
| | 20 | 0.842 | 0.849 | 0.862 | 0.862 |
| | 40 | 0.716 | 0.727 | 0.748 | 0.748 |
| | 80 | 0.589 | 0.602 | 0.627 | 0.627 |
| green | 10 | 0.879 | 0.879 | 0.879 | 0.875 |
| | 20 | 0.707 | 0.708 | 0.712 | 0.707 |
| | 40 | 0.486 | 0.489 | 0.501 | 0.498 |
| | 80 | 0.313 | 0.316 | 0.327 | 0.335 |
| red | 10 | 0.764 | 0.766 | 0.770 | 0.773 |
| | 20 | 0.493 | 0.497 | 0.512 | 0.526 |
| | 40 | 0.243 | 0.247 | 0.271 | 0.288 |
| | 80 | 0.084 | 0.089 | 0.094 | 0.113 |

I claim:

1. A camera-sensitive color negative film which comprises a support having thereon:

2 or 3 green-sensitive silver halide emulsion layers differing in sensitivity such that there is at least one less sensitive green sensitive layer;

2 or 3 red-sensitive silver halide emulsion layers differing in sensitivity such that there is at least one less sensitive red sensitive layer; and 2 or 3 blue-sensitive silver halide emulsion layers differing in sensitivity such that there is at least one less sensitive blue sensitive layer; wherein the blue-sensitive silver halide emulsion layers are arranged further from the support than the green-sensitive and red-sensitive layers;

the less-sensitive blue-sensitive silver halide emulsion layer or layers comprise silver halide emulsions containing at least 50 mol-% AgCl; and the total silver coating of the material is given by the formula $$\text{silver coating} = (0.27 \cdot S) - X,$$

wherein the silver is measured in $g/m_2$, X has a value of 1.9 to 3.8, and S is the sensitivity in DIN.

2. A camera-sensitive color negative film as claimed in claim 1, wherein the less-sensitive blue-sensitive silver halide emulsion layers contain silver halide particles which have an average equivalent particle diameter of 0.2 to 2.0 μm.

3. A camera-sensitive color negative film as claimed in claim 1, wherein the less-sensitive blue-sensitive silver halide emulsion layer or layers contains silver halide particles which have an average equivalent particle diameter of 0.3 to 1.5 μm.

4. A camera-sensitive color negative film as claimed in claim 1, wherein the less-sensitive blue-sensitive silver halide emulsion layer or layers and the less-sensitive green-sensitive silver halide emulsion layer or layers each comprise a silver halide emulsion containing at least 50 mol-% AgCl.

5. A camera-sensitive color negative film as claimed in claim 4, wherein the less-sensitive blue-sensitive silver halide emulsion layer or layers and the less-sensitive green-sensitive silver halide emulsion layer or layers have silver halide particles having an average equivalent particle diameter of 0.2 to 2 μm.

6. A camera-sensitive color negative film as claimed in claim 1, wherein the less sensitive blue-sensitive silver halide emulsion layer or layers, the less sensitive green-sensitive silver halide emulsion layer or layers, and the less sensitive red-sensitive silver halide emulsion layer or layers each comprise a silver halide emulsion containing at least 50 mol-% AgCl.

7. A camera-sensitive color negative film as claimed in claim 6, wherein the less sensitive blue-, green-, and red-sensitive silver halide emulsion layers comprise layers have silver halide particles which have an average equivalent particle diameter of 0.2 to 2 μm.

8. A camera-sensitive color negative film as claimed in claim 1, wherein all the blue-sensitive, green-sensitive and red-sensitive silver halide emulsion layers comprise silver halide emulsions containing at least 50 mol-% AgCl.

9. A camera-sensitive color negative film as claimed in claim 1, wherein the less sensitive blue-sensitive silver halide emulsion layer or layers and the less sensitive green-sensitive silver halide emulsion layer or layers comprise a silver halide emulsion containing at least 80 mol-% AgCl.

10. A camera-sensitive color negative film as claimed in claim 5, wherein the average equivalent particle diameter of the silver halide particles is 0.3 to 1.5 μm.

11. A camera-sensitive color negative film as claimed in claim 1, wherein the less sensitive blue-sensitive silver halide emulsion layer or layers, the less sensitive green-sensitive silver halide emulsion layer or layers, and the less sensitive red-sensitive silver halide emulsion layer or layers comprise a silver halide emulsion containing at least 80 mol-% AgCl.

12. A camera-sensitive color negative film as claimed in claim 7, wherein the silver halide particles have an equivalent particle diameter of 0.3 to 1.5 μm.

13. A camera-sensitive color negative film as claimed in claim 8, wherein all the blue-sensitive, green-sensitive, and red-sensitive silver halide emulsion layers comprise silver halide emulsions containing at least 80 mol-% AgCl.

* * * * *